US006802417B2

(12) United States Patent
Bush

(10) Patent No.: US 6,802,417 B2
(45) Date of Patent: Oct. 12, 2004

(54) EMERGENCY/MEDICAL INFORMATION SYSTEM

(75) Inventor: Monica P. Bush, Sacramento, CA (US)

(73) Assignee: Rescue Blue, Jackson, CA (US)

( * ) Notice: Subject to any disclaimer, the term of this patent is extended or adjusted under 35 U.S.C. 154(b) by 50 days.

(21) Appl. No.: 10/293,281

(22) Filed: Nov. 14, 2002

(65) Prior Publication Data

US 2004/0094446 A1 May 20, 2004

(51) Int. Cl.[7] ..... B65D 69/00
(52) U.S. Cl. ..... 206/232; 206/459.1; 206/459.5
(58) Field of Search ..... 206/232, 459.1, 206/459.5, 528, 530, 534, 538, 539

(56) References Cited

U.S. PATENT DOCUMENTS

| | | | | |
|---|---|---|---|---|
| 632,167 A | | 8/1899 | Biesmeyer | |
| 1,573,663 A | | 2/1926 | Warren | |
| D137,496 S | | 3/1944 | Lustig | |
| 2,729,913 A | | 1/1956 | Holwerda | |
| 3,151,740 A | | 10/1964 | Simon | |
| 4,078,660 A | * | 3/1978 | Lerro | 206/534 |
| 4,197,665 A | | 4/1980 | Siiter | |
| 4,249,330 A | | 2/1981 | Chioffe | |
| D263,622 S | | 3/1982 | Hasson | |
| 4,327,512 A | | 5/1982 | Oliver | |
| 4,333,562 A | | 6/1982 | Todd | |
| 4,336,882 A | * | 6/1982 | Sakwa | 206/537 |
| 4,519,497 A | | 5/1985 | Brinkers | |
| 4,662,091 A | | 5/1987 | Foster et al. | |
| 4,920,672 A | | 5/1990 | Scott, Jr. et al. | |
| 5,775,485 A | | 7/1998 | Dierking | |
| 5,953,288 A | * | 9/1999 | Chappell | 215/230 |
| 5,979,698 A | * | 11/1999 | Deal | 206/459.5 |
| 6,155,409 A | * | 12/2000 | Hettinger | 206/534 |
| 6,516,950 B1 | * | 2/2003 | Robertson | 206/534 |

* cited by examiner

*Primary Examiner*—Luan K. Bui
(74) *Attorney, Agent, or Firm*—Martine & Penilla, LLP

(57) ABSTRACT

A medical information system utilizing a document listing particular medical information of a subject. The document is compressible into a container for holding the document. The container is positioned in a particular place and includes alerting means indicating position of such container and the identification of such container.

6 Claims, 2 Drawing Sheets

EMERGENCY/MEDICAL INFORMATION SYSTEM

BACKGROUND OF THE INVENTION

The present invention relates to a novel and useful system for providing medical information of a subject.

Persons often possess a medical history which is critical to persons administering medical treatment, especially in emergency situations. For example, a medical history may include information concerning prior heart attacks, asthmatic conditions, allergic reactions to medicines, and the like. In addition, medical treatment is often predicted on medical insurance information which must be communicated to the entity administering medical treatment. Moreover, particular types of treatment should be communicated to emergency medical personnel such as "do not resuscitate" (DNR) orders. When a patient is conscious, such medical information is easily obtained. However, when the patient is unconscious, such items are unknown and must be obtained from other sources which often entails a time delay and can result in a life or death situation.

In the past, compact carrying devices have been proposed for transporting personal items such as medicines, candies, film, and the like. For example, U.S. Pat. No. Des. 137,496, U.S. Pat. No. Des. 263,622, and U.S. Pat. No. 5,775,485 describe this type of article.

U.S. Pat. No. 4,662,091 shows a storage apparatus for carrying medical information on a microfiche chip.

U.S. Pat. No. 4,519,497 shows a container which holds personal documents such as a codicil.

U.S. Pat. No. 1,573,663 describes container having a spring ring which contains a motor vehicle license.

U.S. Pat. Nos. 632,167 and 2,729,913 illustrate containers for writing implements and fishing flies, respectively.

U.S. Pat. Nos. 4,151,740 and 4,333,562 teach cap seals which retain vital information papers.

U.S. Pat. Nos. 4,197,665, 4,249,330, 4,327,512, and 4,920,672 show pendants and cap seals which are used to contain medical information in carious formats.

A system which stores medical information about a subject and alerts medical personnel to the existence of the same would be a notable advance in the medical field.

BRIEF SUMMARY OF THE INVENTION

In accordance with the present invention a novel and useful system for providing emergency/medical information of a subject is herein provided.

The system of the present invention utilizes a document which lists emergency/medical information concerning a subject. Such medical information may include emergency contacts, consent forms, insurance coverage identification, medical history information, such as past heart attacks, strokes, and the like, as well as medical conditions which exist such as asthma, hemophilia, and similar afflictions. In addition, allergies to medical treatments, such as penicillin, may be listed. Other pertinent items such as the lack of medical history, "do not resuscitate" (DNR) orders, organ donation wishes, and the like may also be listed on the document. The document may be formed of a conventional sheet of paper of normal size and be rolled or folded into a compact form.

A container is also found in the present invention for holding the compacted document. Such container may take the form of a two-piece canister which fastens together into a single object. The canister may be constructed into an airtight configuration with the proper gasketing or seals to achieve this result. Means is also found for positioning the container to a particular place such as the inside of a cabinet, the inside of a refrigerator, a glove compartment of a car, a case affixed to a vehicle and in other protected areas. Such means may take the form of a clip, a magnetic holder, Velcro fasteners, and any other known support means.

Alerting means is also used in the present invention to direct emergency medical service personnel to the presence of the container and enclosed document. Such alerting means may take the form of an identifying indicia which is mountable to a surface in the vicinity of a place where the container is located, for example, at the entryway of a building, on the outside door of a cabinet, to the exterior of a refrigerator compartment, on an infant seat, and the like. In addition, alerting means is placed on the canister itself to allow the seeker of the canister quick access to the same. Moreover, the alerting means may be placed on other articles such as tags which are connected to briefcases, pocketbooks, belts of the subject, or any other personal items of the subject.

It may be apparent that a novel and useful system for providing medical information has been hereinabove described.

It is therefore an object of the present invention to provide a system for communicating medical information on a subject which utilizes a container enclosing a document which is easy to carry, store, and retrieve.

Another object of the present invention is to provide a system for communicating medical information of a subject to aid emergency rescue workers in the ascertaining of medical information in order to effect treatment of a subject who has been injured or medically distressed in some manner.

A further object of the present invention is to provide a system for communicating medical information which eliminates the use of phones, computer chips, or other time consuming devices in the obtaining of medical information of an injured subject.

Yet another object of the present invention is to provide a system for communicating medical information which utilizes alerting means in the form of a symbol which is instantly recognizable by emergency medical personnel and indicates the presence and location of a medical document in a container.

A further object of the present invention is to provide a system for communicating medical information which utilizes a protected document which is easily updated and reviewable by physicians.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which should be understood in connection with the prior delineated drawings.

Figure 1:
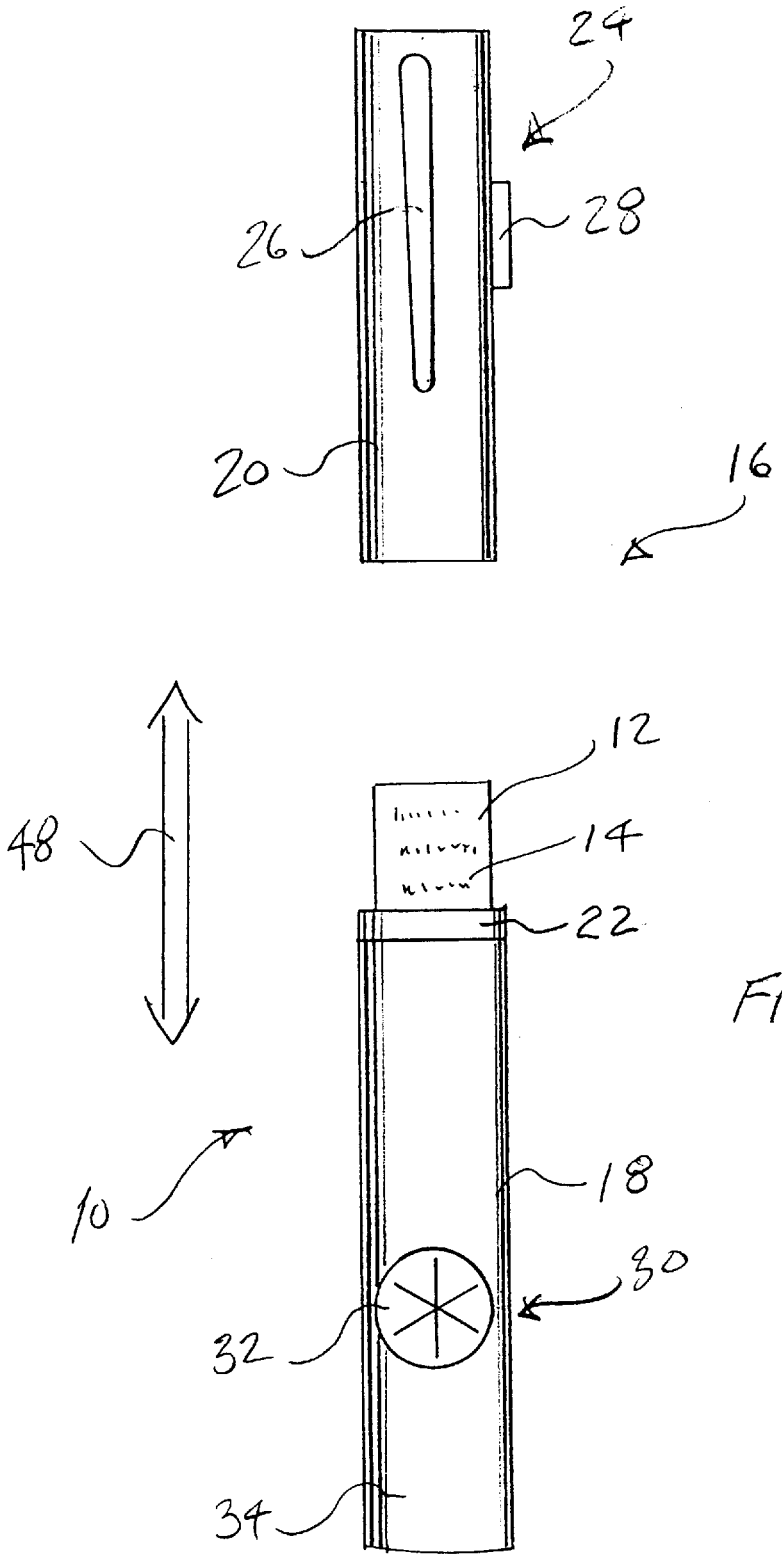
FIG. 1 is a front, elevational, exploded view of the system of the present invention.

The preferred embodiment of the invention as a whole is shown in the drawings. A preferred embodiment of the invention as a whole is shown in the drawings by reference character 10. System 10 includes as one of its elements a document 12 which is intended to list medical information on a subject, shown schematically by markings 14, FIG. 1. Markings 14 would include important medical information about a subject such as medical history, past heart attacks, strokes, and the like. Also, medical conditions such as asthma, diabetes, and other serious infirmities would be listed on document 14. Document 14 may also reveal allergies to medical treatment such as penicillin, as well as preferred treatments for infections, such as sulfa drugs. Medical treatment preferences may also be listed on document 14 including "do not resuscitate" (DNR) instructions, organ donation wishes, and the like. Document 14 is easily rolled into a compact condition as depicted in FIG. 1. Moreover, information contained on document 14 may be entered in pencil or other erasable media to permit updating of the same as time goes on.

System 10 also utilizes a container 16 shown as including a lower portion 18 and an upper portion 20 which is removable and connectable to lower portion 18. Such connection may take the form of forming upper portion 20 as a hollow member which snaps into hollow lower portion 18. Ring 22 reinforces the connecting area between upper portion 20 and lower portion 18. Once connected, upper and lower portion 18 forming container 16 may be positioned in any convenient or particular place. In this regard, means 24 may be used to position the container 16. For example, means 24 may take the form of a flexible clip 26 to place container 16 in a pocket or against a flange or flap of some sort. Magnetic strip 28 allows container 16 to be mounted against a metallic surface. Of course, container 16 may be simply placed in a cabinet, glove compartment, drawer, and other convenient areas within a house or vehicle.

Figure 2:
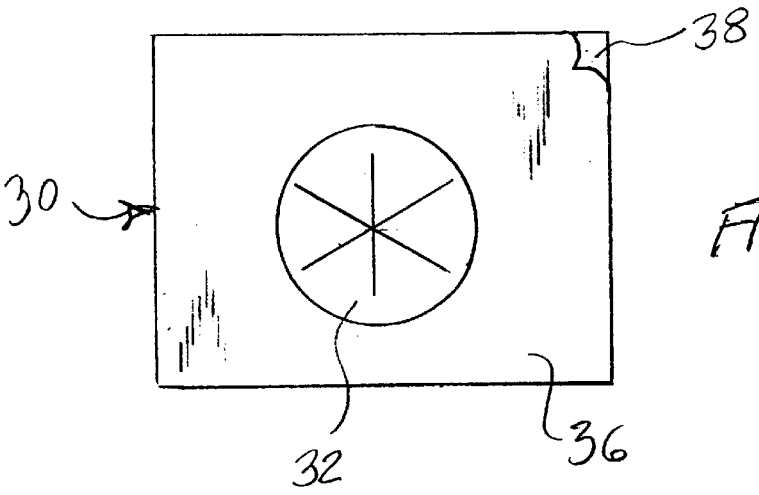
FIG. 2 is a front elevational view of embodiment of the alerting means employed with the present invention.
Figure 3:
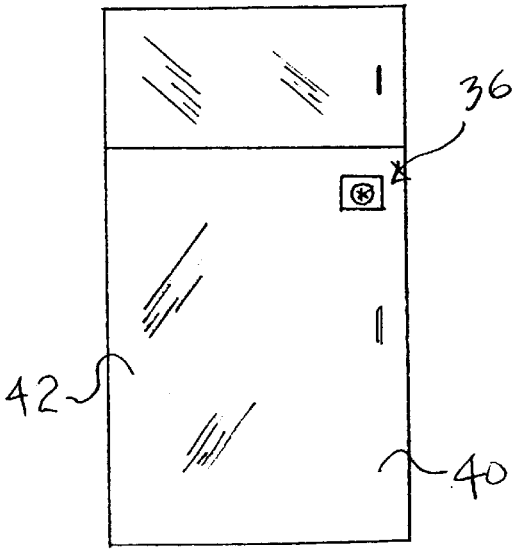
FIG. 3 is an illustration of the use of the alerting means of the present invention on a refrigerator.
Figure 4:
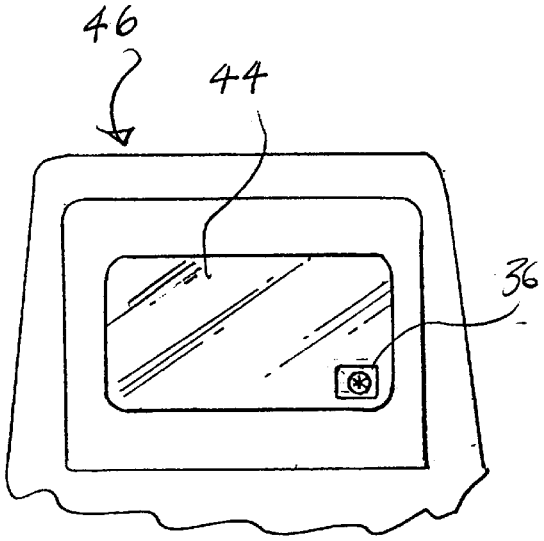
FIG. 4 is an illustration of the alerting means of the present invention used with a window.

Most importantly, alerting means 30 is employed to indicate the presence of container 16. Alerting means 30 includes a symbol or indicia 32 which is placed directly against the curved outer wall 34 of lower portion 18 of container 16, FIG. 1. Alerting means also includes a placard 36 which may be in the form of a decal. FIG. 2 indicates a protective layer 38 for decal 36 which is removed prior to placement of decal 36 on a surface. For example, FIGS. 3 and 4 depict the use of placard or decal 36. In FIG. 3, a refrigerator 40 is shown where decal 36 has been placed on door portion 42. Decal 36 indicates that container or canister 16 lies within refrigerator 40. FIG. 4 shows decal 36 on a window 44 of a vehicle 46. Decal 36 in FIG. 4 indicates that container 16 lies within vehicle 46. Of course, decal or placard 36 may be placed on other structures such as cabinets, compartments, desks, and the like.

In operation, the user prepares document 12 by turning pertinent medical information about a subject indicated by markings 14. Document 12 is then rolled or otherwise made into a compact configuration and placed within container 16 lower portion 18. Upper portion 20 of container 16 is then mated with lower portion 18 according to directional arrow 48. Directional arrow 48 also indicates that upper portion 20 of container 16 may be removed from lower portion 18 to retrieve document 12 in order to ascertain the medical information indicated by markings 14 or to update the same. Alerting means 32 in the form of a symbol or indicia 32 is then applied to the outer wall 30 of container 16 to identify the same on identical indicia 32 found on decal 36 is also employed by placement of the same in the vicinity of container 16. In the examples depicted in FIGS. 3 and 4, container 16 has been placed in refrigerator 40 or vehicle 46. Decal 36 has been placed on the door 42 of refrigerator 40 or a window 44 or vehicle 46, as the case may be. Of course, other places may be employed to store container 16 which would accompany the use of decal or placard 36 on a particular surface to indicate presence of container 16. It may be apparent that decal or placard 36 is always placed on a visible surface to assure that emergency medical personnel, for example, will retrieve container 16 should a subject whose medical information is contained therein need medical assistance. However, alerting means 32 may be employed to obtain container 16 for whatever purpose.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A system for communicating information about a subject, comprising:

a. a document listing the medical information of a subject;

b. a container for said document;

c. means for positioning said container to a particular place; and d. alerting means for indicating the presence of said container in said particular place and including an identifying indicia, said alerting means being mountable to a surface in the vicinity of said particular place and on said container.

2. The system of claim 1 in which said alerting means comprises a placard including identifying indicia thereupon.

3. The system of claim 1 in which said alerting means further comprises multiple articles each including said identifying indicia.

4. The system of claim 3 in which one of said multiple articles comprises a tag and a loop holding said tag, said loop being attachable to a personal article of the subject.

5. The system of claim 1 in which said means for positioning said container to a particular place comprises a clip.

6. The system of claim 1 in which said means for positioning said container comprises a magnet.

* * * * *